US012515904B2

(12) United States Patent
Takahashi et al.

(10) Patent No.: US 12,515,904 B2
(45) Date of Patent: Jan. 6, 2026

(54) SHEET FEEDING APPARATUS, IMAGE FORMING SYSTEM, AND CONTROL PROGRAM

(71) Applicant: KONICA MINOLTA, INC., Tokyo (JP)

(72) Inventors: Michio Takahashi, Hino (JP); Yusuke Yamamoto, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 551 days.

(21) Appl. No.: 17/968,359

(22) Filed: Oct. 18, 2022

(65) Prior Publication Data

US 2023/0166932 A1 Jun. 1, 2023

(30) Foreign Application Priority Data

Nov. 26, 2021 (JP) ..... 2021-191802

(51) Int. Cl.
*B65H 3/48* (2006.01)
*B65H 3/12* (2006.01)
(Continued)

(52) U.S. Cl.
CPC ..... *B65H 7/12* (2013.01); *B65H 3/128* (2013.01); *B65H 3/48* (2013.01); *B65H 7/16* (2013.01);
(Continued)

(58) Field of Classification Search
CPC . B65H 7/12; B65H 3/128; B65H 3/48; B65H 7/16; B65H 2511/524; B65H 2801/06
See application file for complete search history.

(56) References Cited

U.S. PATENT DOCUMENTS 5,478,066 A * 12/1995 Yoshida ..... B65H 3/128 271/99
2014/0265105 A1* 9/2014 Shimoyama ..... B65H 3/48 271/12
(Continued)

FOREIGN PATENT DOCUMENTS

JP 2015020827 A 2/2015
JP 2020070166 A 5/2020

OTHER PUBLICATIONS

Office Action (Notice of Reasons for Refusal) issued on Jul. 1, 2025, by the Japanese Patent Office in corresponding Japanese Patent Application No. 2021-191802, and an English Translation of the Office Action. (7 pages).

*Primary Examiner* — Thomas A Morrison
(74) *Attorney, Agent, or Firm* — Buchanan Ingersoll & Rooney PC

(57) ABSTRACT

A sheet feeding apparatus includes: a placer that allows a plurality of sheets to be placed on the placer; an air feeder including a front-end fan that generates an airflow from a front-edge side in a sheet feeding direction of a bundle of sheets placed on the placer toward the bundle of sheets; an attracting conveyor that attracts an uppermost sheet separated by the air feeder from the bundle of sheets placed on the placer and conveys the uppermost sheet; a detector that detects, in the conveyance of the uppermost sheet by the attracting conveyor, an amount of co-feeding of a next sheet together with the uppermost sheet; and a hardware processor that executes air-volume control to the front-end fan such that an air volume of the front-end fan increases with an increase in the amount of co-feeding detected by the detector.

13 Claims, 13 Drawing Sheets

(51) Int. Cl.
*B65H 7/12* (2006.01)
*B65H 7/16* (2006.01)

(52) U.S. Cl.
CPC .... *B65H 2511/524* (2013.01); *B65H 2801/06* (2013.01)

(56) References Cited

U.S. PATENT DOCUMENTS

2015/0021848 A1* 1/2015 Mizuno ..... B65H 3/48 271/12
2016/0167905 A1* 6/2016 Enomoto ..... B65H 5/062 271/11

* cited by examiner

| ADJUSTED FAN AIR VOLUME | AMOUNT OF CO-FEEDING | | |
|---|---|---|---|
| | 100—67 | 66—34 | 33—0 |
| | LARGE | MIDDLE | SMALL |
| FRONT-END FAN AIR VOLUME f1 | AIR VOLUME MAXIMUM VALUE | AIR VOLUME INCREASE | CRITERION |
| SIDE FAN AIR VOLUME f2 | AIR VOLUME LOWER LIMIT | AIR VOLUME DECREASE | CRITERION |

FIG. 15

| AMOUNT OF CORRECTION df1 FOR FRONT-END FAN | | AMOUNT OF CO-FEEDING | | | | |
|---|---|---|---|---|---|---|
| | | 100—80 | 79—60 | 59—40 | 39—20 | 19—0 |
| | | MAXIMUM | LARGE | MIDDLE | SMALL | NONE |
| SHEET INFORMATION (BASIS WEIGHT) | LESS THAN 80g/m² | 45% | 40% | 30% | 20% | 0% |
| | LESS THAN 135g/m² | 55% | 50% | 40% | 30% | 0% |
| | LESS THAN 216g/m² | 55% | 50% | 40% | 30% | 0% |
| | LESS THAN 300g/m² | 55% | 50% | 40% | 30% | 0% |
| | LESS THAN 450g/m² | 65% | 60% | 50% | 40% | 0% |

SHEET FEEDING APPARATUS, IMAGE FORMING SYSTEM, AND CONTROL PROGRAM

The entire disclosure of Japanese patent Application No. 2021-191802, filed on Nov. 26, 2021, is incorporated herein by reference in its entirety.

BACKGROUND

Technological Field

The present invention relates to a sheet feeding apparatus, an image forming system, and a control program.

Description of the Related Art

A copier, a facsimile, a printer, and an image forming system including these functions are provided with a sheet feeding unit. The sheets stacked and stored in the sheet feeding unit are separated one by one and sent. Each of the fed sheets is conveyed to the image former to form an image onto the sheet.

Electrophotographic image forming systems have recently been used in the field of light printing such as print on demand (POD), and it is required to be able to respond to various needs regarding image quality and sheets. In particular, regarding sheets, gloss coated sheets, high quality sheets, overprinting sheets, and recycled sheets may be used, for example.

The conventional sheet feeding apparatus of a roller conveyance type conveys a sheet by the frictional force between the sheet and the surface of the roller. A sufficient frictional force cannot be obtained with a gloss coated sheet having a very smooth surface, and thus the sheet feeding is unstable. Further, in the case of an overprinting sheet or a recycled sheet, foreign matters such as a release material (separation powder) or dust attached to the surface of the sheet are transferred to the surface of the roller. The transfer reduces the frictional force between the sheet and the surface of the roller, resulting in long-term unstable sheet feeding.

As a technique for dealing with such a drawback, an air-assist sheet feeding apparatus (hereinafter, also referred to as air sheet feeding apparatus) has been proposed (e.g., JP 2020-70166 A, particularly in FIGS. 12 and 13). The air sheet feeding apparatus blows air to the upper side face of the sleet bundle stacked on a sheet feeding tray from the periphery of the sheet bundle to send the air between the sheets. Then, the uppermost sheet is floated and separated from the sheet bundle. Such separated uppermost sheets as described above are conveyed one by one by a sheet feeding roller.

The air sheet feeding apparatus in JP 2020-70166 A sets a sheet feeding parameter on the basis of information on the sheet type of sheets to be used. The air sheet feeding apparatus aggregates the conveyance results based on such sheet feeding parameters as described above and analyzes the conveyance results in a management device connected to a network to set (update) the sheet feeding parameters. Further, on the basis of the amount of co-feeding or the number of jamming as a conveyance result, the air sheet feeding apparatus uses a sheet feeding parameter to adjust the air volume of a fan for blowing air to the sheets. The air sheet feeding apparatus commonly uses the setting after the adjustment for each image forming apparatus.

However, as described in JP 2020-70166 A, in constant use of one setting based on the amount of co-feeding, for example, in a case where the environment in the apparatus changes every day, even if the setting appropriate for conveyance on one day is applied to another day, stable sheet feeding is not always performed. In addition, for a light sheet small in sleet basis weight, the orientation of the sheet greatly varies due to air blowing. The variation changes the separating performance in accordance with the orientation of the sheet, resulting in frequent change in the amount of co-feeding and in jam occurrence. Therefore, the defect at the time of sheet feeding is difficult to be reduced. Further, the air sheet feeding apparatus in JP 2020-70166 A controls the air volumes of a plurality of fans that the sheet feeding tray is provided with, and the characteristics for each fan are not reflected.

SUMMARY

The present invention has been made in view of the above circumstances, and an object of the present invention is to provide a sheet feeding apparatus capable of stable sheet feeding due to control such that the air volume of a front-end fan increases as an increase in the amount of co-feeding detected, and a control program for execution of sheet feeding processing.

To achieve the abovementioned object, according to an aspect of the present invention, a sheet feeding apparatus reflecting one aspect of the present invention comprises: a placer that allows a plurality of sheets to be placed on the placer, an air feeder including a front-end fan that generates an airflow from a front-edge side in a sheet feeding direction of a bundle of sheets placed on the placer toward the bundle of sheets; an attracting conveyor that attracts an uppermost sheet separated by the air feeder from the bundle of sheets placed on the placer and conveys the uppermost sheet; a detector that detects, in the conveyance of the uppermost sheet by the attracting conveyor, an amount of co-feeding of a next sheet together with the uppermost sheet; and a hardware processor that executes air-volume control to the front-end fan such that an air volume of the front-end fan increases with an increase in the amount of co-feeding detected by the detector.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 15 is an exemplary correction table indicating the relationship between sheet information, the amount of co-feeding, and the amount of correction (for the front-end fan) according to the modification.

DETAILED DESCRIPTION OF EMBODIMENTS

Figure 1:
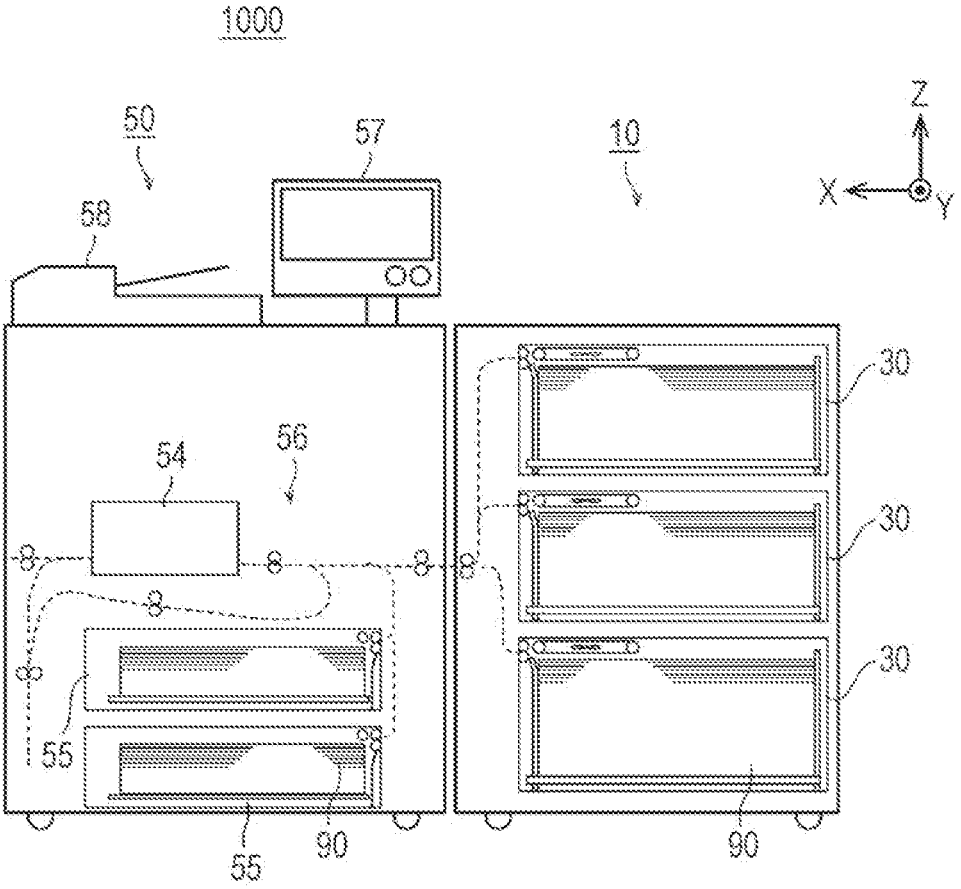
FIG. 1 is a schematic configuration view of an image forming system including a sheet feeding apparatus according to the present embodiment.

Hereinafter, one or more embodiments of the present invention will be described with reference to the drawings. However, the scope of the invention is not limited to the disclosed embodiments. In the description of the drawings, the same components are denoted with the same reference signs and redundant description will be omitted. Further, the dimensional ratios in the drawings are exaggerated for the convenience of description, and thus may differ from the actual ratios. In the drawings, an upward-and-downward direction is a Z direction, a direction from the front face of an image forming apparatus to the back face thereof is a Y direction, and a direction orthogonal to the Y and Z directions is an X direction. The Y direction is also referred to as a width direction or a rotational axis direction. The X direction is also referred to as a conveyance direction (or a sheet feeding direction). In the embodiments of the present embodiment, sheets include a printing sleet (hereinafter, simply referred to as a sheet) and various films. In particular, the sheets include a sheet produced at least one of use plant-derived mechanical pulp and use of chemical pulp. Further, the types of sheets include a gloss sheet and matte sheet as coated sheets, and a plain sheet and high-quality sheet as non-coated sheets.

Figure 2:
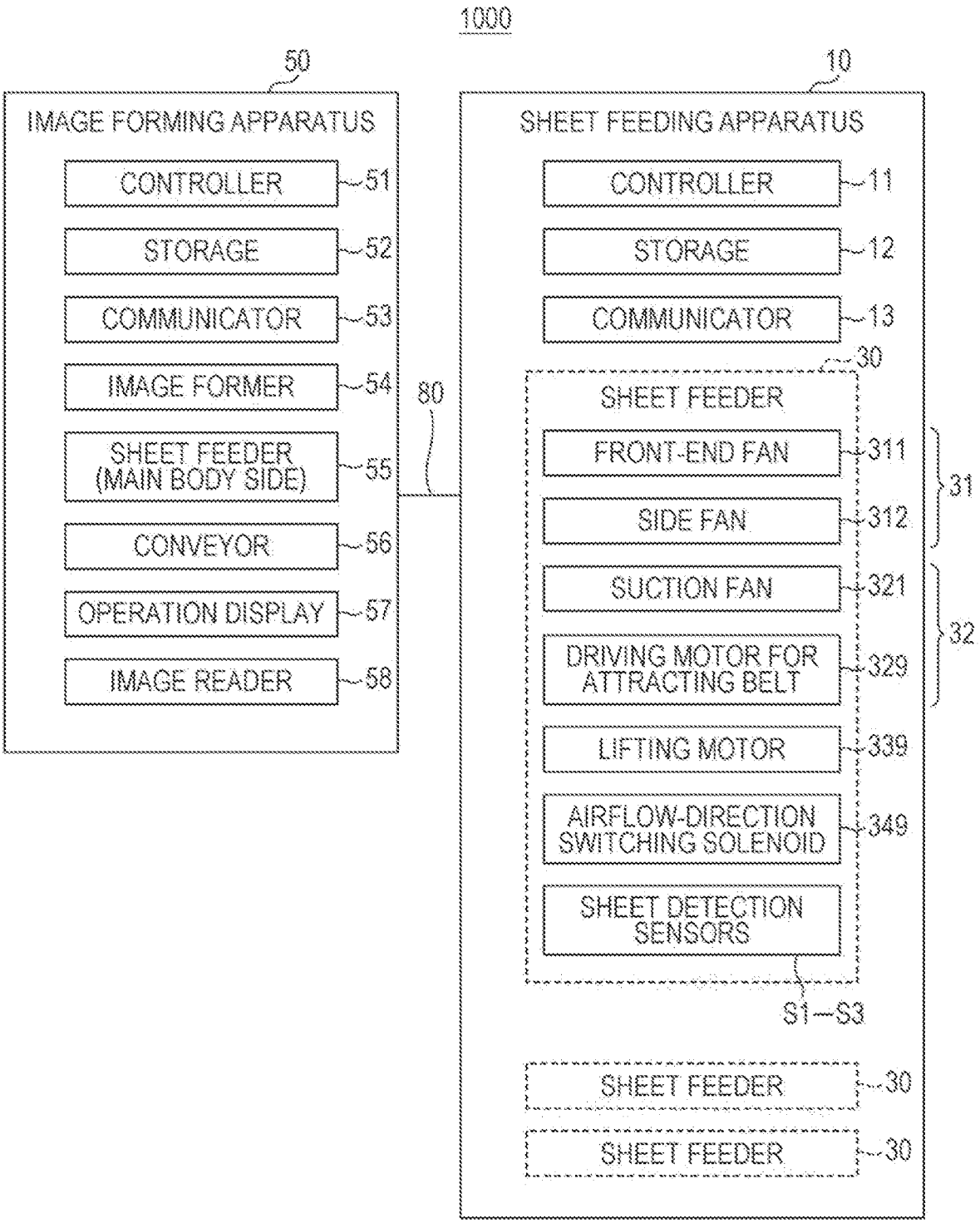
FIG. 2 is a block diagram of the image forming system.

FIG. 1 is a schematic configuration view of an image forming system 1000 including a sheet feeding apparatus 10 according to the present embodiment. FIG. 2 is a block diagram of the image forming system 1000.

The image forming system 1000 includes the sheet feeding apparatus 10 and an image forming apparatus 50. The sheet feeding apparatus 10 and the image forming apparatus 50 are mechanically coupled to each other and electrically connected to, for example, a cable.

(Sheet Feeding Apparatus 10)

The sheet feeding apparatus 10 includes a controller 11, a storage 12, a communicator 13, and one or more sheet feeders 30. The sheet feeding apparatus 10 feeds and conveys one by one the sheets 90 stored in such a sheet feeder 30 as described above, and sends the sheets 90 to the image forming apparatus 50 in the subsequent stage. The sheet feeder 30 is an air-assisted sheet feeder, and is also referred to as a sheet feeding tray. The specific configuration of the sheet feeder 30 will be described later in detail (e.g., in FIG. 3).

The controller 11 includes a central processing unit (CPU) and a memory. The CPU is a control circuit including a multi-core processor that executes control of the above components and various types of arithmetic processing according to a program. Each function of the sheet feeding apparatus 10 is exerted by the CPU executing the corresponding program. The memory is a high-speed accessible main storage device that temporarily stores programs and data, as a work area. As the memory, for example, adopted is a dynamic random access memory (DRAM), a synchronous dynamic random access memory (SDRAM), or a static random access memory (SRAM).

The storage 12 is a large-capacity auxiliary storage device that stores various programs including an operating system and various pieces of data. As the storage, for example, adopted is a hard disk, a solid state drive, a flash memory, or a read only memory (ROM). The storage 12 stores sheet information regarding the sheets 90 stored in the sheet feeder 30, a correction table in use for sheet-feeding control to be described later, or a relational expression. The sheet information is acquired from the image forming apparatus 50 by the communicator 13 functioning as an acquirer. At the image forming apparatus 50, the sheet information is generated due to detection output from a built-in medium sensor or input by the user from an operation display 57. The sheet information includes the classifications of size, basis weight, and sheet type. The basis weight has several to more than ten classifications divided at optional basis weights in a range of up to 62 g/m$^2$ to 450 g/m$^2$. Examples of the classifications of the sheet type include gloss sheet, matte sheet, plain sheet, high-quality sheet, and high-gloss sheet. The correction table or the relational expression indicates the relationship between the "the amount of co-feeding" and fan air volume (or the amount of fan correction), or the "the amount of co-feeding", the sheet information, and the fan air volume (or the amount of fan correction) (see FIG. 13 or FIG. 15 to be described later.)

The communicator 13 is as an interface for communicating with an apparatus such as the image forming apparatus 50.

(Image Forming Apparatus 50)

The image forming apparatus 50 includes a controller 51, a storage 52, a communicator 53, an image former 54, a sheet feeder 55, a conveyor 56, the operation display 57, and an image reader 58. Hereinafter, the sheet feeder 55 is also referred to as a main-body-side sheet feeder 55 in order to be distinguished from the sheet feeder 30 of the sheet feeding apparatus 10.

Similarly to the controller 11, the controller 51 includes a CPU and a memory, and controls the image forming apparatus 50. The controller 5I further controls the entire image forming system 1000 in cooperation with the controller 11 of the sheet feeding apparatus 10.

The storage 52 has a configuration similar to that of the storage 12, and stores various piece of data. The communicator 53 is as an interface for communicating with an apparatus such as the sheet feeding apparatus 10. The communicator 53 also communicates with, for example, a personal computer (PC) through a network.

The image former 54 is, for example, an electrophotographic image former, and includes a photoconductive drum, a charging electrode, an exposer, a developer, a transferer, and a cleaner. The electrostatic latent image formed on the photoconductive drum is developed as a toner image by the developer. The timing of the sheet 90 conveyed from the sleet feeder 30 or the main-body-side sheet feeder 55 is controlled by a registration roller. The sheet 90 is synchronized with the toner image, and conveyed to the transferer. The sheet 90 with the toner image transferred thereon by the transferer is conveyed to a fixer on the downstream side, and the toner image is fixed onto the sheet 90.

The main-body-side sheet feeder 55 is a sheet feeder of a roller conveyance type. Such sheets 90 as described above are each fed and conveyed one by one by the main-body-side sheet feeder 55 due to the frictional force between the sheet 90 and the surface of the roller. Note that the main-body-side sheet feeder 55 may be an air-assisted sheet feeder similar to the sheet feeder 30, and sheet feeding processing described later may be applied to the main-body-side sheet feeder 55.

The conveyor 56 includes a conveyance path with a plurality of conveying rollers disposed, and conveys a sheet 90 fed from the corresponding sheet feeder 30 or 55.

The operation display 57 includes a touch panel, a numeric keypad, a start button, and a stop button, and displays a state of the image forming system 1000 and receives an instruction for printing from the user. Further, the input of sheet information such as the type and basis weight of each sheet placed on the corresponding sheet feeder 30 or 55 is received from the user.

The image reader 58 is disposed on an upper portion of the main body of the image forming apparatus 50, and includes a sensor array, an optical system, a light emitting diode (LED) light source, document glass, and a housing that houses these components. The image reader 58 reads a document conveyed by an auto document feeder (ADF) or a document placed on the document glass to generate image data.

(Sheet Feeder 30)

Figure 3:
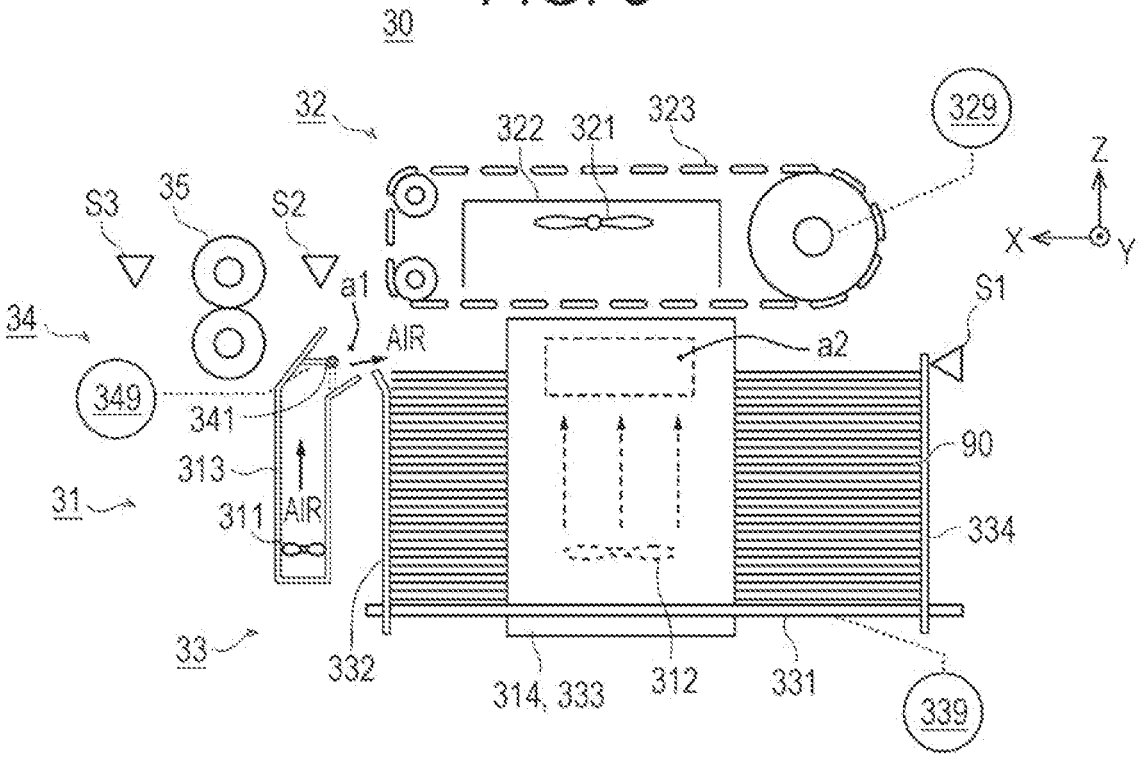
FIG. 3 is a sectional view of a sheet feeder of the sheet feeding apparatus.
Figure 4:
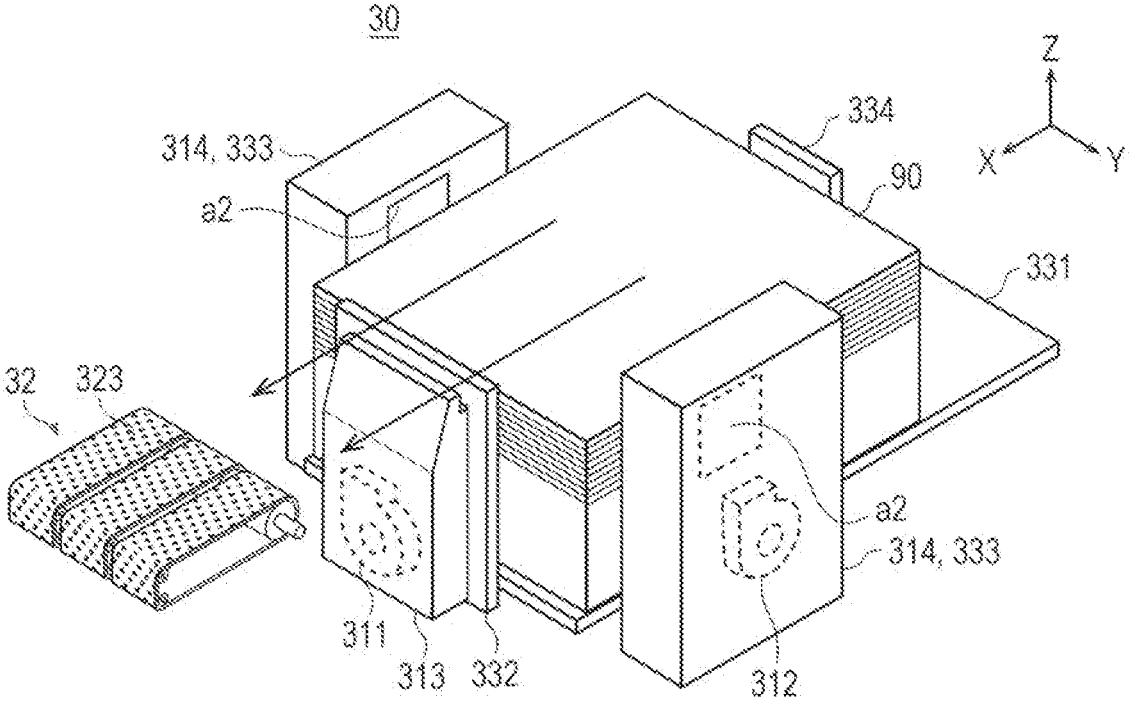
FIG. 4 is a perspective view of the sheet feeder.

Next, the configuration of the sheet feeder 30 will be described with reference to FIGS. 2, 3, and 4. FIGS. 3 and 4 are, respectively, a sectional view and a perspective view of the sheet feeder 30.

The sheet feeder 30 includes an air feeder 31, an attracting conveyor 32, a sheet storage 33, a switch 34, a conveyor 35, and a plurality of sheet detection sensors S1 to S3.

The air feeder 31 includes a front-end fan 311, side fans 312, a duct 313, and ducts 314. Each of the front-end fan 311 and the side fans 312 can control the air volume in multiple stages. In the following description, it is assumed that the air volume of each of the fans 311 and 312 can be varied within a range of 0 to 100% on the basis of an input pulse width modulation (PWM) value (0 to 100%). The one side fan 312 disposed on one side of the air feeder 31 and the other side fan 312 disposed on the other side thereof are variably controlled so as to be the same in output in air volume control.

The duct 313 is disposed on the front-edge side of a bundle of sheets 90 (hereinafter, simply referred to as a sheet bundle) stacked on a placer 331 (to be described later) of the sheet storage 33. The front-end fan 311 inside the duct 313 generates an airflow from the front-edge side in the sheet feeding direction toward the sheet bundle (sheets). The airflow is discharged from a blowout port a1 provided in an upper portion of the duct 313.

The one duct 314 is provided on the one side of the air feeder 31 and the other duct 314 is provided on the other side thereof in the width direction of the sheet bundle. Each side fan 312 inside the corresponding duct 314 generates an airflow from a side face side of the side fan 312 toward the sheet bundle. The airflow is discharged from a blowout port a2 provided in an upper portion of the duct 314 toward the sheet bundle. At a stage where sheets 90 are separated from the sheet bundle and floated (a first stage in FIG. 5A described later), the sheets 90 are separated from the sheet bundle and floated by the airflows, in a substantially horizontal direction, generated by the front-end fan 311, the one side fan 312, and the other side fan 312 toward an upper portion of the sleet bundle. Among the floated sheets 90, the uppermost sheet 90 is attracted by the attracting conveyor 32 and conveyed in the sheet feeding direction.

The attracting conveyor 32 is disposed above the downstream side (font-edge side of the sheets) in the conveyance direction of the sheet bundle. Note that, for example, in FIG. 3, the length of the attracting conveyor 32 is exaggerated to the extent similar to the length of each sheet 90 in the conveyance direction.

The attracting conveyor 32 includes a suction fan 321, a duct 322, a plurality of attracting belts 323, a plurality of conveying rollers, and a driving motor 329. As illustrated in FIG. 4, the plurality of attracting belts 323 (three in the example of FIG. 4) is arranged in parallel in the width direction. These endless attracting belts 323 are supported rotatably by a large-diameter roller connected to the driving motor 329 and two small-diameter rollers smaller than the large-diameter roller. The attracting belts 323 are each provided with a large number of small-diameter through holes. A suction port facing the attracting belts 323 is provided below the duct 322. The suction fan 321 makes the inner side of each attracting belt 323 have a negative pressure. The air sucked by the suction fan 321 is discharged to the back face side of the apparatus through the duct 322.

The sheet storage 33 includes the placer 331 having an upper face on a horizontal plane, a front-end regulating plate 332, a pair of side regulating plates 333, a rear-end regulating plate 334, and a lifting motor 339. The respective positions of the side regulating plates 333 and the rear-end regulating plate 334 are variable by the user with a moving mechanism (not illustrated) in accordance with the size of sheets 90 stored. The respective inner faces of the front-end regulating plate 332, the side regulating plates 333, and the rear-end regulating plate 334 are aligned so as to be substantially in contact with the four sides of the sheet bundle stored. Each side regulating plate 333 and the corresponding duct 314 are provided integrally. The duct 314 is provided inside the side regulating plate 333, and the corresponding side fan 312 is housed in the duct 314.

The sheet detection sensors S1 to S3 each include an optical sensor alone or in combination with an actuator. The sheet detection sensor S1 detects the presence or absence of a sheet 90 at the detection position (Z direction).

The sheet detection sensor S1 detects that the uppermost portion of the sheet bundle placed on the placement face of the placer 331 of the sheet storage 33 has arrived at a predetermined height position. The controller 11 controls the lifting motor 339 in accordance with the output of the sheet detection sensor S1 such that the height of the placer 331 is adjusted such that the uppermost portion of the sheet bundle is at the predetermined height position.

The switch 34 includes a shutter 341, an airflow-direction switching solenoid 349, and a coupling member (not illustrated). The shutter 341 is disposed inside the duct 313. The airflow-direction switching solenoid 349 activates the shutter 341, so that the shutter 341 switches the direction of the airflow from the front-end fan 311 between the upward direction and the downward direction. The shutter 341 and the airflow-direction switching solenoid 349 may be replaced with a plate-shaped airflow-direction switching plate and a driving motor, and the airflow direction may be changed in multiple stages instead of the two stages.

Figure 5A:
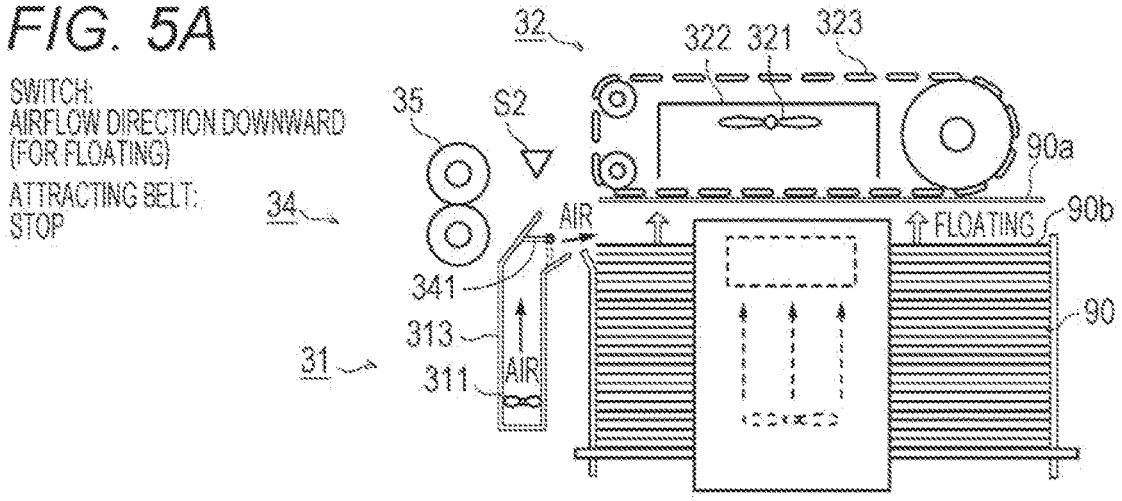
FIG. 5A schematically illustrates a sheet feeding operation (first stage)
Figure 5B:
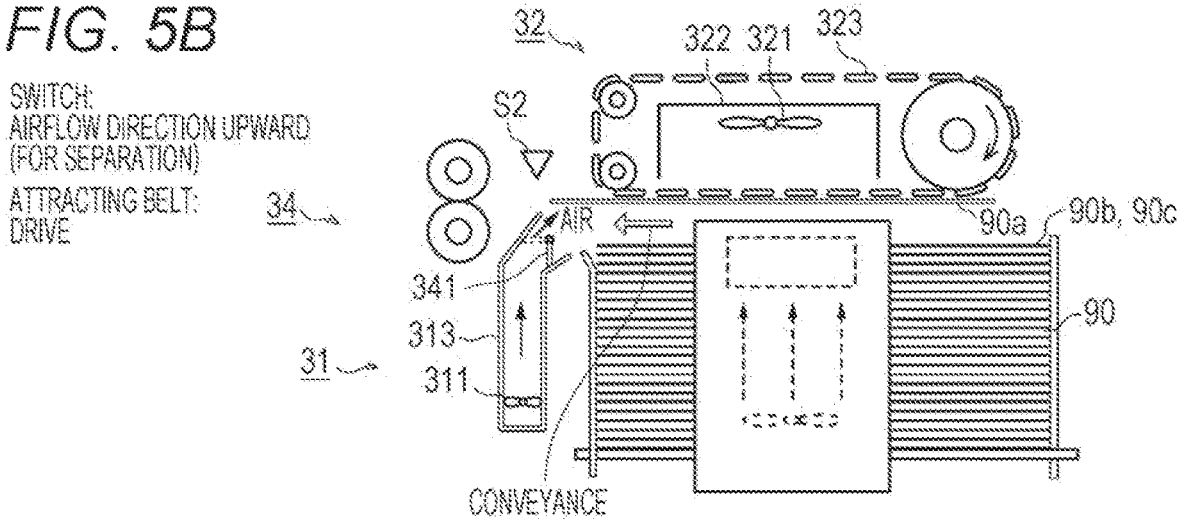
FIG. 5B schematically illustrates a sheet feeding operation (second stage)

With the shutter 341 at the initial position and the downward airflow formed (FIG. 5A to be described later), a substantially horizontal airflow is formed toward the upper portion of the sheet bundle. Change of the position of the shutter 341 due to activation of the airflow-direction switching solenoid 349 by the controller 11 results in formation of an obliquely upward airflow toward the attracting conveyor 32 disposed above the sheet bundle, with an upward airflow formed (FIG. 5B to be described later). Turning off the airflow-direction switching solenoid 349 returns the shutter 341 to the initial position with, for example, a spring.

The conveyor 35 includes one or more pairs of com-eying rollers, and conveys the sheet 90 fed and conveyed by the attracting conveyor 32 to the downstream side. The sheet detection sensors S2 and S3 each detect that the sheet 90 has been normally conveyed to a predetermined position on the conveyance path.

(Sheet Feeding Operation and Amount of Co-Feeding)

Figure 5C:
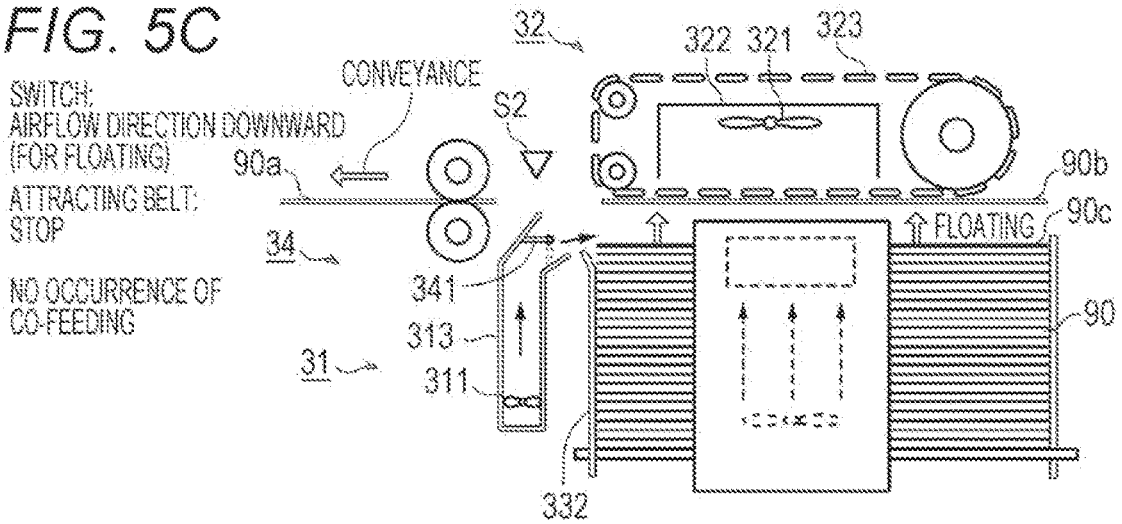
FIG. 5C schematically illustrates a sheet feeding operation (first stage) for the next sleet without co-feeding.
Figure 6A:
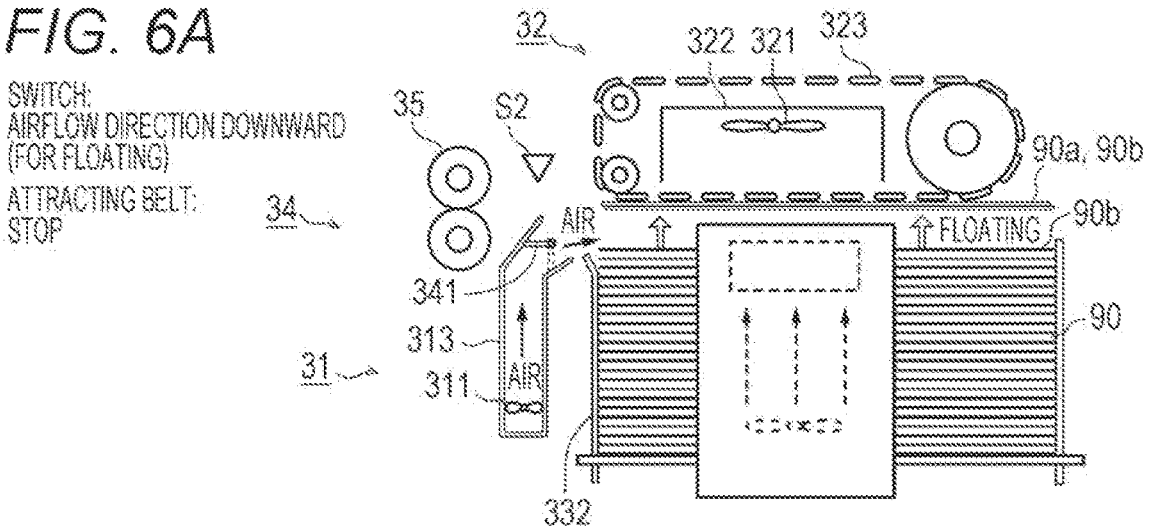
FIG. 6A schematically illustrates a sheet feeding operation (first stage)
Figure 6B:
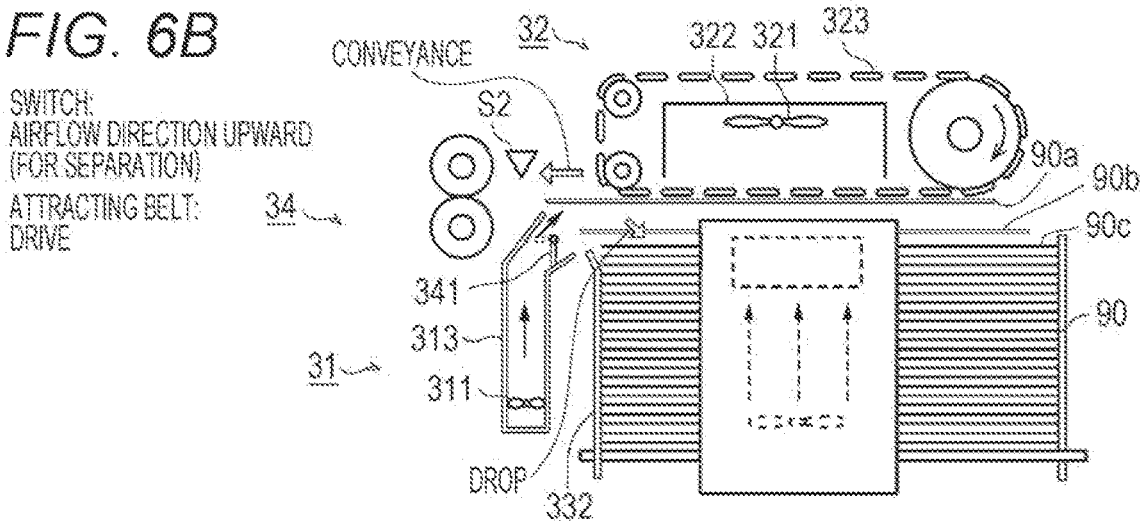
FIG. 6B schematically illustrates a sheet feeding operation (second stage)
Figure 6C:
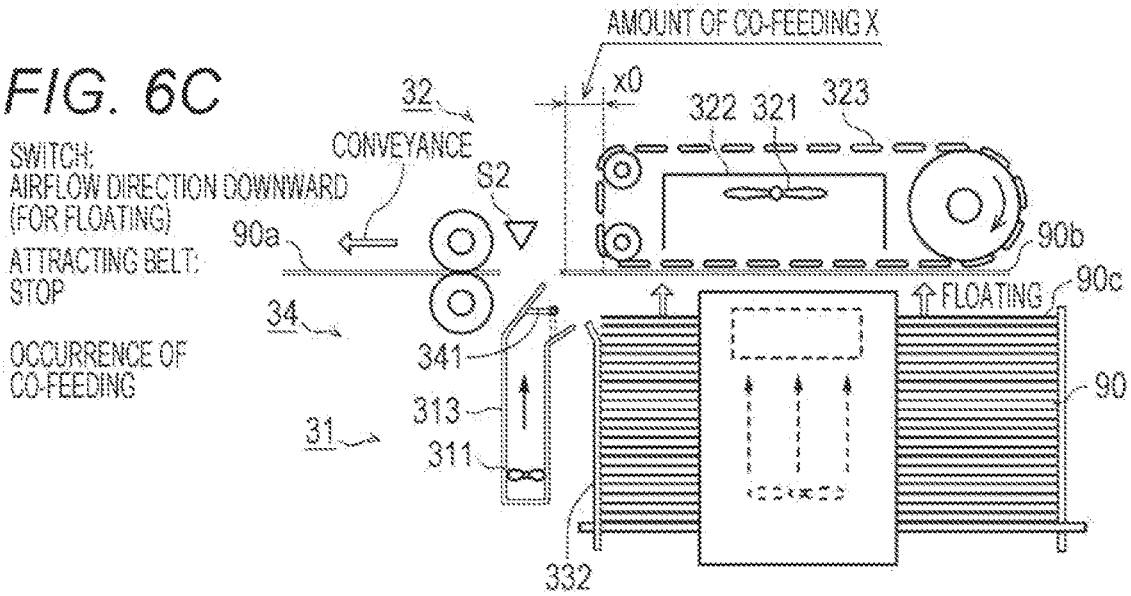
FIG. 6C schematically illustrates a sheet feeding operation (first stage) for the next sheet with co-feeding.

Next, with reference to FIGS. 5A to 6C, the sheet feeding operation by the sheet feeder 30 described above and the amount of co-feeding will be described. FIGS. 5A to 5C schematically illustrate an ideal sheet feeding operation in time series without co-feeding (the amount of co-feeding=0 (mm)). FIGS. 6A to 6C schematically illustrate a sheet feeding operation in time series with co-feeding (the amount of co-feeding=X mm). In FIGS. 5A to 6C, the first sheet, the second sheet, and the third sheet at a certain point of time are denoted as a sheet 90*a*, a sheet 90*b*, and a sheet 90*c*, respectively. Every time a single sheet 90 is fed, the sheet feeding apparatus 10 repeats a sheet feeding operation at the first stage (sheet floating) and a sheet feeding operation at a second stage (conveying and separating).

In the sheet feeding operation at the first stage illustrated in FIG. 5A, the uppermost sheet 90*a* of the sheet bundle is floated by the substantially horizontal airflow of the front-end fan 311 and the side fans 312. The floated sheet 90*a* is attracted to the surface of the attracting belts 323 by the suction fan 321. A detection sensor (not illustrated) may detect that the sheet 90*a* is attracted to the attracting belts 323. At the first stage illustrated in FIG. 5A, the shutter 341 is at the initial position, and a downward airflow is formed by the front-end fan 311. The downward airflow has a function of separating the uppermost sheet 90 due to sending of air between each sheet 90 of the sheet bundle. The first stage ends after an elapse of a predetermined time since suction of a sheet 90 to the attracting belt 323 has been detected, or after an elapse of a predetermined time since the first stage after end of the second stage has started.

In the sheet feeding operation at the second stage illustrated in FIG. 5B, the controller 11 activates the airflow-direction switching solenoid 349, so that the front-end fan 311 forms an upward airflow. This airflow has a function of separating a sheet other than the uppermost sheet 90*a* attracted to the attracting belts 323 at the second stage. For example, the next sheet 90*b* is floated in addition to the sheet 90*a* and attracted by the attracting belts 323, the sheet 90*b* is separated. Then, the sheet 90*b* is dropped and then returned to the sheet bundle. The first sheet 90*a* is conveyed downstream by the attracting belts 323 and the conveyor 35. The second stage ends and the transition to the next first stage is performed, for example, after an elapse of a predetermined time since the sheet detection sensor S2 has detected the sheet 90*a* or after the sheet detection sensor S2 has no longer detected a sheet.

In the sheet feeding operation at the first stage for the next sheet 90*b* illustrated in FIG. 5C, an operation similar to that in FIG. 5A is performed again and the subsequent sheet feeding operation is repeated. Further, in FIG. 5C, the preceding sheet 90*a* is continuously conveyed downstream by the conveyor 35.

(Case with Co-Feeding)

Next, refer to FIGS. 6A to 6C. FIGS. 6A, 6B, and 6C correspond to FIGS. 5A, 5B, and 5C, respectively.

Unlike FIG. 5A, FIG. 6A illustrates the next sheet 90*b* floated as the sheet 90*a* is lifted. Further, in FIG. 6B, the sheet 90*b* has been separated and dropped by separation at the second stage and the sheet bundle has been shifted. For example, this occurs in an inappropriate air volume of each of the fans 311 and 312, or in a situation where separation from the sheet bundle cannot be easily performed due to the surface property and surface state of the sheets 90.

Figure 11:
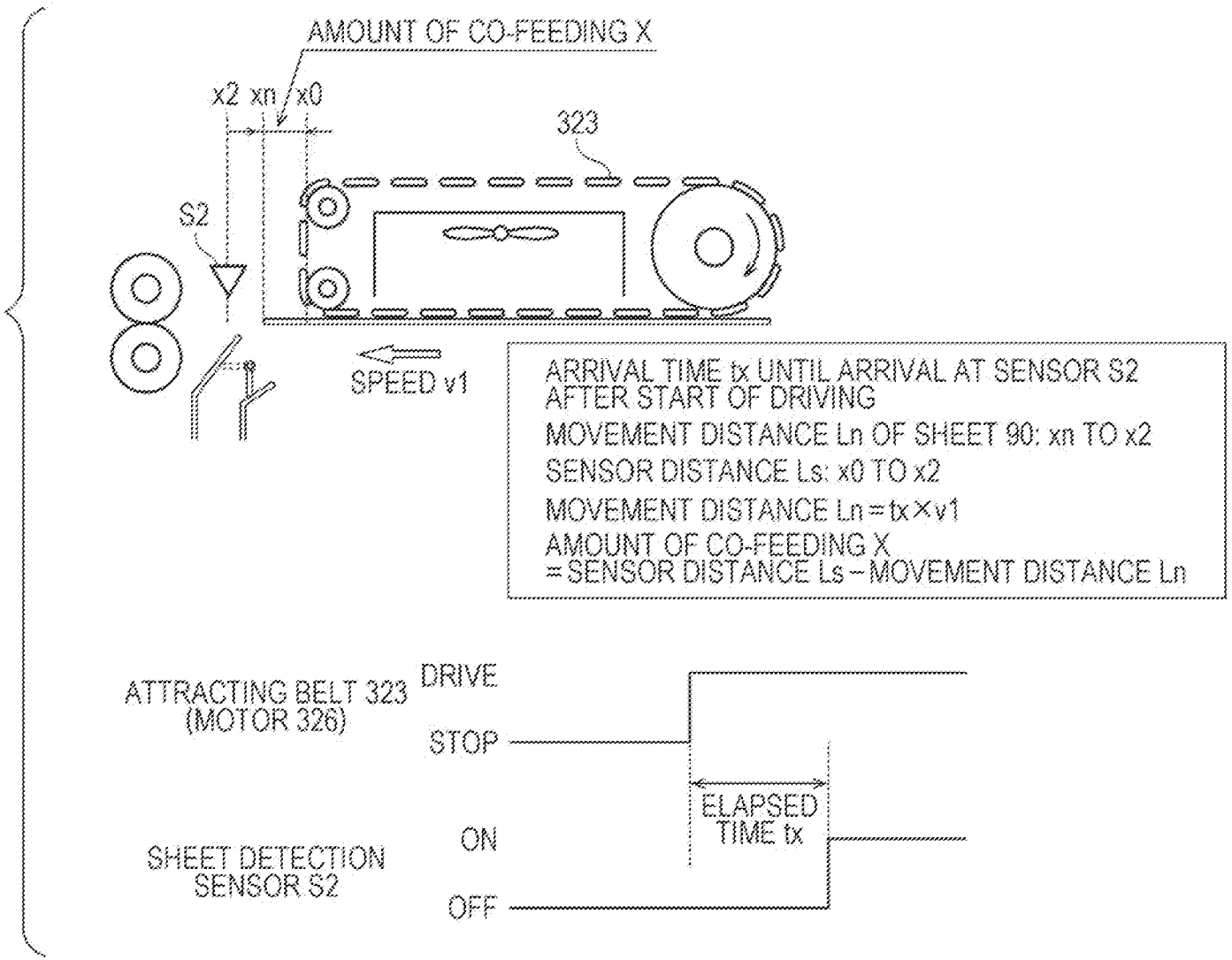
FIG. 11 is an explanatorily schematic illustration of a method of calculating the amount of co-feeding.

At the first stage in FIG. 6C after the second stage in FIG. 6B, due to the influence in the second stage in FIG. 6B, the sheet 90*b* is attracted to the attracting belts 323 in occurrence of co-feeding. In the present embodiment, the degree of co-feeding is evaluated on the basis of the amount of co-feeding X. The co-feeding itself does not directly cause a drawback, but is effective as an index indicating a precursor of sheet feeding failure. The co-feeding causes a sheet feeding failure if it increases excessively. The amount of co-feeding is an amount by which the next sheet 90*b* is conveyed together with the sheet 90*a* in conveyance of the uppermost sheet 90*a*, and is the amount of protrusion with respect to an appropriate position at the end of the first stage. Specifically, as illustrated in FIG. 6C, it is the amount of shift of the position (xn) of the front edge of the sheet 90 attracted to the attracting belt 323 with respect to the appropriate position (reference position x0) at the end of the first stage. Here, the reference position x0 is a predetermined position in the X direction, and is, for example, a sheet front-edge position when the first sheet 90 of the sheet bundle set (replenished) in the sheet feeder 30 is attracted to the attracting belts 323 without co-feeding. The amount of co-feeding is detected in co-feeding amount detection processing (by detector) to be described later (FIG. 11).

(Amount of Co-Feeding and Fan Air Volume)

Figure 7:
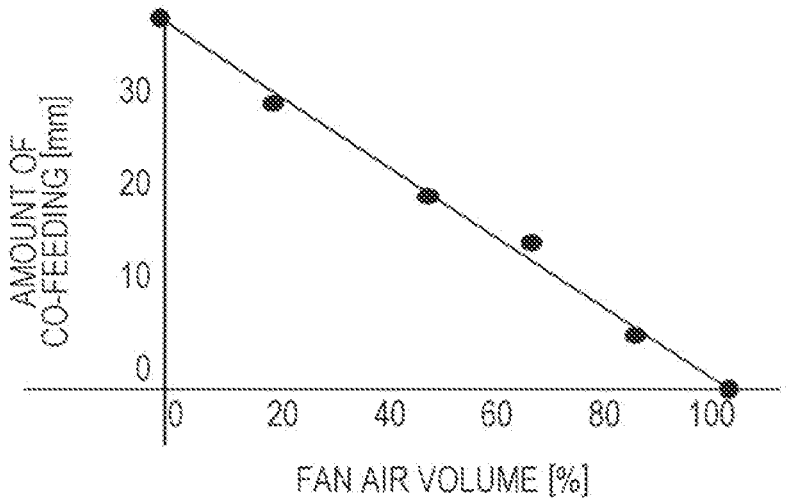
FIG. 7 is a graph indicating the relationship between the amount of co-feeding and the air volume of a front-end fan.
Figure 8:
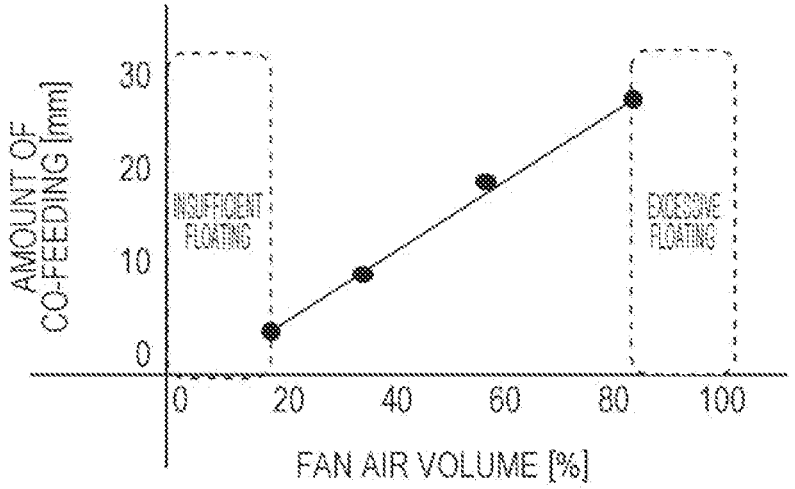
FIG. 8 is a graph indicating the relationship between the amount of co-feeding and the air volume of a side fan.

Next, the relationship between the respective air volumes of the fans 311 and 312 and the amount of co-feeding amount will be described. FIG. 7 is a graph indicating the relationship between the amount of co-feeding and the air volume of the front-end fan 311. FIG. 8 is a graph indicating the relationship between the amount of co-feeding and the air volume of each side fan 312.

As indicated in FIG. 7, it can be seen that the amount of co-feeding decreases as an increase in the air volume of the front-end fan 311. That is, it is effective to increase the air volume of the front-end fan 311 in order to suppress the amount of co-feeding as it increases.

On the other hand, as indicated in FIG. 8, it can be seen that the amount of co-feeding increases as an increase in the air volume of the side fan 312. That is, it is effective to decrease the air volume of the side fan 312 in order to suppress the amount of co-feeding as it increases. As described above, the front-end fan 311 and the side fans 312 have different tendencies in the air volume and the amount of co-feeding. Therefore, the inventors of the present application have found that it is difficult to reduce the amount of co-feeding and sheet feeding failures by uniform change of the air volumes as in JP 2020-70166 A.

(Sheet Feeding Processing)

Figure 9:
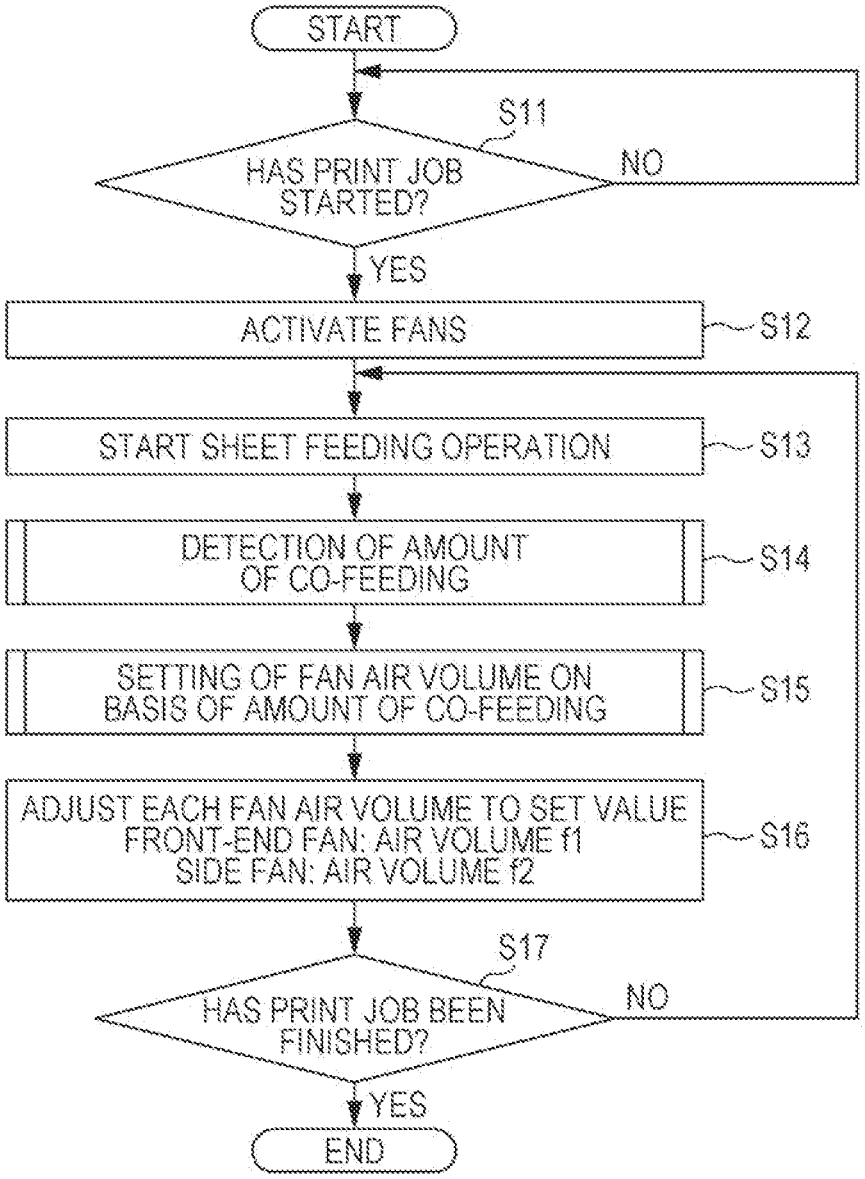
FIG. 9 is a flowchart illustrating sheet feeding processing of the sheet feeding apparatus according to a first embodiment.

FIG. 9 is a flowchart illustrating sheet feeding processing of the sheet feeding apparatus 10 according to a first embodiment.

(Step S11)

If the controller 11 receives the start of execution of a print job, the controller 11, the processing proceeds to step S12. For example, if the image forming apparatus 50 receives an instruction for printing from the user through the operation display 57, the controller 11 receives an instruction for starting the execution from the controller 51.

(Steps S12 and S13)

The controller 11 activates the fans 311 and 312. At the same time, the suction fan 321 is activated to start a sheet feeding operation. Here, the sheet feeding operation starts, and the uppermost sheet 90 is attracted to the attracting belts 323 (first stage). At the timing of sheet feeding after the attraction of the sheet 90 to the attracting belts 323, the attracting belts 323 start driving to start conveyance of the sheet 90 (second stage).

(Step S14)

The controller 11 causes the detector to detect the amount of co-feeding. Hem, the detector is a function achieved by a timer function of the controller 11 and the sheet detection sensor S2.

(Step S201)

Figure 10:
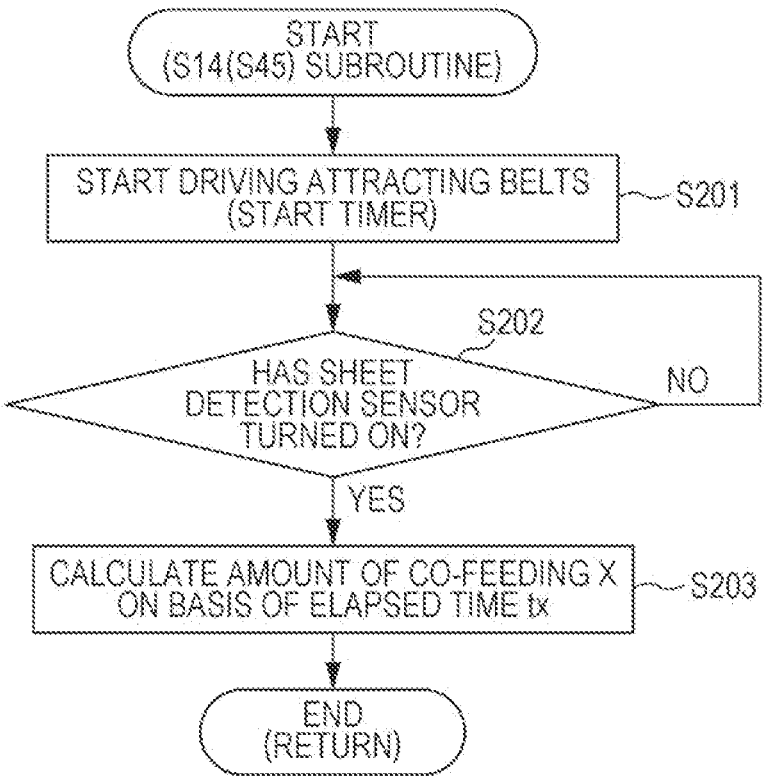
FIG. 10 is a subroutine flowchart illustrating processing in step S14.

FIG. 10 is a subroutine flowchart illustrating the co-feeding amount detection processing (step S14). The controller 11 starts counting with the timer at the timing when the second stage is reached and the attracting belts 323 starts driving.

(Step S202)

The controller 11 monitors the sheet detection sensor S2 at a cycle of 1 msec, for example, and waits until the sheet detection sensor S2 turns ON (sheet is present) (NO). If the sheet detection sensor S2 has turned ON and passage (arrival) of the front edge of the sheet 90 has been detected (YES), the processing proceeds to step S203.

(Step S203)

The controller 11 calculates the amount of co-feeding X on the basis of the elapsed time tx as a timer value at the point of time of detection of the passage. Specifically, the controller 11 calculates on the basis of the elapsed time tx, the conveyance speed v1, the reference position x0 in the x direction, and the position x2 of the sheet detection sensor S2. The movement distance Ln is calculated by multiplying the elapsed time tx by the conveyance speed v1. On the basis of the movement distance Ln and the difference between the reference position x0 and the position of the sheet detection sensor x2 (sensor distance Ls), calculated is the amount of co-feeding X as the position of the front edge of the sheet 90 with respect to the reference position x0 at the start of driving of the attracting belts 323, that is, at the start of the second stage. For example, the elapsed time tx=Ls/v1 is obtained for the amount of co-feeding X=0 with the minimum co-feeding (index of 0), and the elapsed time tx=0 is obtained for the amount of co-feeding X=Ls (position x2) with the maximum co-feeding (index of 100). After the calculation, the processing in FIG. 10 ends. Then, the processing returns to the processing in FIG. 9, and the processing in step S15 and subsequent steps is executed (end (return)).

(Step S15)

Figures 12, 13:
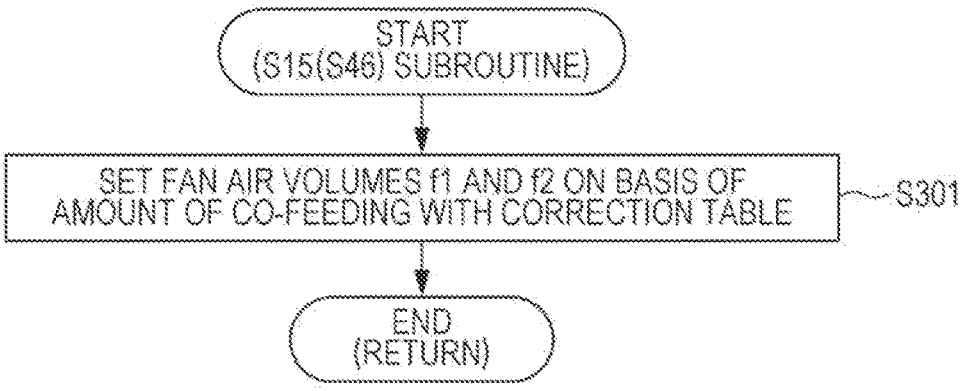
FIG. 12 is a subroutine flowchart illustrating processing in step S15.
FIG. 13 is an exemplary correction table indicating the relationship between the amount of co-feeding and fan air volume.

Here, the air volume f1 of the front-end fan 311 and the air volume f2 of each side fan 312 are set on the basis of the amount of co-feeding calculated in step S14 (by the detector). FIG. 12 is a subroutine flowchart illustrating fan-air-volume correction processing (step S15). FIG. 13 is a correction table indicating the relationship between the amount of co-feeding and air volume.

(Step S301)

Here, the controller 11 sets the air volume of each of the fans 311 and 312 with such a correction table as indicated in FIG. 13 stored in advance in the storage 12. In the correction table, the amount of co-feeding is divided into three stages of large, middle, and small. When the ideal amount of co-feeding is an index of 0 and the allowable maximum value is an index of 100, large, middle, and small correspond to top, middle, and bottom obtained by dividing these values of indexes almost equally among three. For example, the index of 100 corresponds to the allowable upper limit. This upper limit is a value slightly smaller than the amount of co-feeding that causes a conveyance jam, for example, the amount of co-feeding of 30 mm. The upper limit of 30 mm also corresponds to the position of the sheet detection sensor S2 (sensor distance Ls). Note that instead of the correction table, the air volume correction may be performed with a relational expression indicating the amount of co-feeding and the corrected air volume.

As indicated in FIG. 13, in the present embodiment, the air volume f1 of the front-end fan 311 is made larger than the criterion and the air volume f2 of each side fan 312 is made smaller than criterion as an increase in the amount of co-feeding, corresponding to the relationship in FIGS. 7 and 8 found by the inventors of the present application. Note that the criterion air volume is an air volume set on the basis of a setting table stored in advance in accordance with the type of sheet (basis weight). Ina case where the air volume f2 of each side fan 312 cannot perform the floating function, a different sheet feeding failure may occur. Thus, a predetermined lower limit is set in advance, and the air volume f2 is not set to be equal to or less than the lower limit (see "insufficient floating" in FIG. 8). After the setting of the air volume of each of the fans 311 and 312, the processing in FIG. 12 ends. Then, the processing returns to the processing in FIG. 9, and the processing in step S16 and subsequent steps is executed (end (return)).

(Step S16)

The controller 11 adjusts the air volume of each of the fans 311 and 312 so as to be the set value in step S15, and reflects the air volume in the subsequent setting at the time of sheet feeding of sheets 90. For example, in a print job of continuously printing on the sheets 90, the air volume f1 of the front-end fan 311 and the air volume f2 of each side fan 312 adjusted on the basis of the amount of co-feeding X in the feeding of the preceding sheet 90 (n-th sheet) are applied at the time of feeding of the next sheet 90 ((n+1)-th sheet).

(Step S17)

If the print job has not been finished (NO), the controller 11 returns the processing to step S13 and repeats the subsequent processing. Otherwise, if the print job has been finished (YES), the processing ends.

(Modifications)

Figure 14:
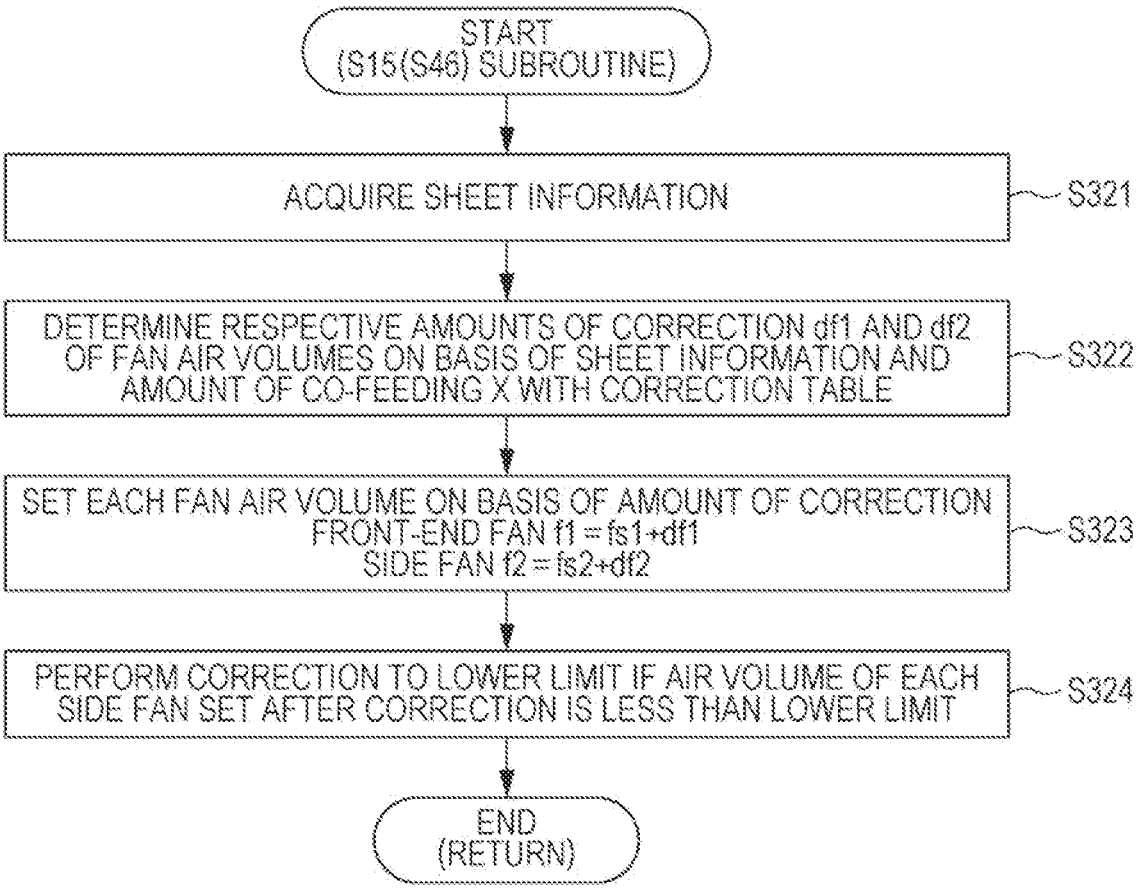
FIG. 14 is a subroutine flowchart illustrating processing in step S14 according to a modification.

Next, fan-air-volume correction processing according to modifications will be described with reference to FIGS. 14 and 15. FIG. 14 is a subroutine flowchart illustrating the processing in step S15. FIG. 15 is an exemplary correction table indicating the relationship between sheet information, the amount of co-feeding, and the amount of correction (for the front-end fan). In the following modifications, air-volume control is executed on the basis of the sheet information in addition to amount of co-feeding.

(Step S321)

The controller 11 acquires the sheet information stored in the storage 12 in association with the sheet feeder 30 as a target. The sheet information is acquired in advance by the acquirer (communicator 13), and is, for example, the basis weight of the stored sheet 90.

(Step S322)

The controller 11 determines the amount of correction (amount of delta) df1 of the air volume of the fan 311 and the amount of correction (amount of delta) df2 of the air volume of each fan 312 on the basis of the corresponding correction tables stored in the storage 12. In the correction table related to the amount of correction df1 of the front-end fan 311 indicated in FIG. 15, the amount of connection increases as the basis weight increases. For example, when the basis weight is 64 g/m$^2$ and the amount of co-feeding is the index of 100 (e.g., the maximum value of 30 mm), the amount of correction df1 of the front-end fan 311 is 45%. Similarly, for each side fan 312, the amount of correction df2 is determined on the basis of the correction table. As indicated in FIG. 15, the amount of correction of the front-end fan 311 is described that the value in the positive direction (direction in which the air volume increases) increases as an increase in the amount of co-feeding. However, in the correction table of the side fan 312, the amount of correction is set such that the absolute value in the negative direction (direction in which the air volume decreases) increases as an increase in the amount of co-feeding.

(Step S323)

The controller 11 sets the air volume of each fan on the basis of the amounts of correction df1 and df2 determined in step S323 with the following expressions. As described above, df2 is set to a negative value. The air volume f1 of the front-end fan 311=fs1+df1

The air volume f2 of each side fan 312=fs2+df2

Here, fs1 and fs2 are the criterion air volumes before correction, and are fixed values set in advance according to basis weights (the values are larger as the basis weights are larger). As described above, the air volume of each of the front-end fan 311 and the side fans 312 is varied with the PWM value, and the variable range is between 0 to 100%. For example, for the criterion air volume fs1=30% with a basis weight of 64 g/m$^2$ and the amount of correction df1=45% determined in step S322, the corrected air volume is 75% obtained by adding them. Instead of using such a fixed value, the amount of correction may be added to the immediately preceding adjusted air volume. For example, the air volume of the front-end fan 311 is set to $f1_n=f1_{n-1}+df1$ ($f1_n$ is the current adjusted air volume, and $f1_{n-1}$ is the immediately preceding adjusted air volume).

(Step S324)

If the air volume f2 of each side fan 312 set in step S323 is less than a predetermined lower limit, the controller 11 corrects the air volume f2 to the lower limit. The lower limit is the minimum value at which the floating effect at the first stage can be secured as described above. The lower limit may be a different lower limit in accordance with the type of sheet (basis weight) (the lower limit is larger as an increase in the basis weight). For example, when the air volume f2 of each side fan 312 set in step S323 is 5% and is less than the lower limit of 10%, the controller 11 corrects the air volume f2 to the lower limit of 10%.

As described above, the sheet feeding apparatus according to the present embodiment includes the attracting conveyor, the detector that detects the amount of co-feeding by which the next sheet is conveyed together with the uppermost sheet in conveyance of the uppermost sheet by the attracting conveyor; and the controller. The controller executes the air-volume control to the front-end fan such that the air volume of the front-end fan increases as an increase in the amount of co-feeding detected by the detector. This arrangement enables a reduction in the amount of co-feeding, and enables the stable sheet feeding. Further, in the present embodiment, the control of the air volumes of the front-end fan and the side fans is executed such that the air volume of the front-end fan increases and the air volume of each side fan decreases as an increase in the amount of co-feeding detected by the detector As a result, more stable sheet feeding can be executed.

Second Embodiment

Figure 16:
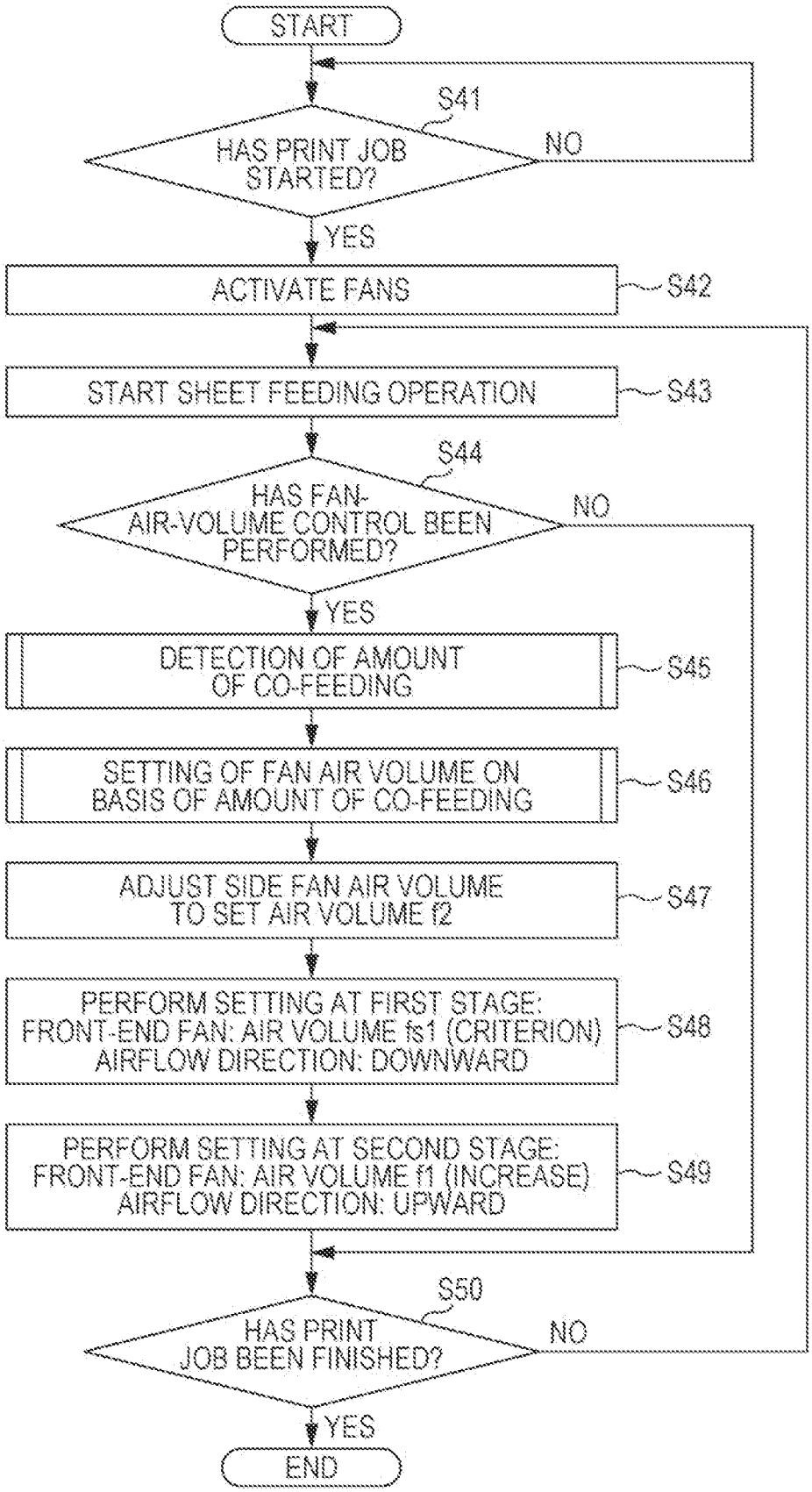
FIG. 16 is a flowchart illustrating sheet feeding processing of a sheet feeding apparatus according to a second embodiment.

Next, a sheet feeding apparatus 10 according to a second embodiment will be described with reference to FIG. 16. FIG. 16 is a flowchart illustrating sheet feeding processing of the sleet feeding apparatus 10 according to the second embodiment. The configurations other than those described below are the same as the configurations of the first embodiment and the modifications in FIGS. 1 to 15, and thus the description will be omitted. In the second embodiment described below, the execution timing of fan-air-volume control is limited to a predetermined period of time from the activation of the fan or limited to the second stage.

(Steps S41 to S43)

These pieces of processing are the same as those in steps S11 to S13 in FIG. 9. In accordance with reception of a print job by an image forming apparatus 50, each fan is activated and a sheet feeding operation starts.

(Step S44)

The controller 11 determines whether or not the timing for performing the fan-air-volume control. During execution of the print job, the fan air volume may be adjusted for the entire period of time as in the first embodiment. However, if the adjustment is performed excessively, the fan air volume may deviate from the optimum value. Further, during a period time after the start of the execution of the print job and the activation of a fan remains stopped, it is likely that the floating state of the sheet 90 is unstable because the airflow of the fan is unstable. Therefore, in a predetermined period of time, the fan-air-volume control corresponding to the subsequent amount of co-feeding is performed (YES), and the processing proceeds to step S45. Otherwise, if not in the predetermined period of time, the fan-air-volume control is not performed (NO), and the processing proceeds to step S50. Here, the predetermined period of time is any one of the following two types. The first type is a period of time ranging from the start of the activation of the fans (step S42) until the amount of co-feeding becomes equal to or less than a predetermined value. The predetermined value is, for example, 0 mm, or a case where the predetermined value becomes equal to or less than an index of 10 as the 1/10 of an index of 100 when the allowable maximum value is the index of 100. The cycle of the predetermined period of time is a timing at which the amount of co-feeing becomes the predetermined value or less first. The second type is from the start of the activation of the fans (step S42) until a predetermined number of sheets are fed or the predetermined period of time elapses. For example, the predetermined number of sheets are several tens of sheets and the predetermined period of time is within one minute.

(Steps S45 and S46)

Here, similarly to steps S14 and S15 in FIG. 9, the amount of co-feeding is detected in the subroutine processing in FIG. 10 and FIG. 12 or FIG. 14, and the air volume f1 of the front-end fan 311 and the air volume f2 of each side fan 312 are set on the basis of the detected amount of co-feeding.

(Step S47)

The controller 11 adjusts the air volume of the side fan 312 to the air volume f2 set in step S46. For example, the air volume f2 set on the basis of the amount of co-feeding X in feeding of the preceding sheet 90 (n-th sheet) is applied at the time of feeding the current sheet 90 ((n+1)-th sheet) (at both the first stage and the second stage).

(Step S48)

The controller 11 sets the air volume of the front-end fan 311 at the time of feeding of the sheet 90 ((n+1)-th sheet) at the first stage to a criterion air volume fs1. The criterion air volume fs1 is set in advance in accordance with the basis weight as described above. At the first stage, the direction of the airflow of the front-end fan 311 switched by a switch 34 is downward (for example, see FIG. 5A).

(Step S49)

In a case where the shift to the second stage is made due to attraction of the sheet 90 ((n+1)-th sheet) to an attracting belt 323, the controller 11 causes the switch 34 to switch the airflow direction of the front-end fan 311 upward (for example, see FIG. 5B). At the same time, the air volume f1 set on the basis of the amount of co-feeding X in the feeding of the preceding sheet (n-th sheet) in step S46 is applied to the air volume of the front-end fan 311 at the time of feeding the current sheet 90 ((n+1)-th sheet) at the second stage.

(Step S50)

Similarly to step S17 in FIG. 9, if the print job has not been finished (NO), the controller 1I returns the processing to step S43 and repeats the subsequent processing. Otherwise, if the print job has been finished (YES), the processing ends.

As described above, in the second embodiment, the execution timing of the fan-air-volume control is applied to the predetermined period of time from the activation of a fan, so that the air-volume control can be performed in an appropriate period of time. The air volume of the front-end fan 311 increases in accordance with the amount of co-feeding at the time of the feeding at the second stage, so that the air volume can be controlled appropriately and the stable sheet feeding can be performed.

The configuration of the sheet feeding apparatus 10 and the configuration of the image forming system 1000 including the sheet feeding apparatus have been described as the main configurations in description of the features of the embodiments and are not limited to the above configurations, and thus various modifications can be made within the scope of claims. Further, the configuration of a typical sheet feeding apparatus or the configuration of a typical image forming system are not excluded.

In each of the embodiments, the sheet feeding apparatus 10 is provided separately from the image forming apparatus 50, but may be integrally formed with the image forming apparatus 50. Note that the main-body-side sheet feeder 55 may be an air-assisted sheet feeder similar to the sheet feeder 30, and sheet feeding processing in which the air-volume control in each embodiment may be applied to the main-body-side sheet feeder 55.

Further, the example in which the air volume at the time of feeding the next sheet ((n+1)-th sheet) is adjusted on the basis of the amount of co-feeding X at the time of feeding the preceding sheet 90 (n-th sheet) has been described, but this is not limiting. Thus, the air volume may be adjusted on the basis of the result of averaging a plurality of detection results. Furthermore, the example in which the sheet detection sensor S2 is provided as the detector for the amount of co-feeding has been described, but this is not limiting. Thus, a camera or an optical line sensor may be disposed near the sheet detection sensor S2 and it may be used as a detector. On the basis of analysis of image data acquired by the camera or the line sensor, determination is made to the position of the front edge of the sheet 90 at the start of the second stage to detect the amount of co-feeding.

Still furthermore, ways and methods for executing the various types of processing by the sheet feeding apparatus 10 and the image forming system 1000 according to the embodiments are achievable by either a described hardware circuit or a programmed computer. The program may be provided by, for example, a computer-readable recording medium such as a universal serial bus (USB) memory or a digital versatile disc (DVD)-ROM, or may be provided online through a network such as the Internet. In this case, the program recorded in the computer-readable recording medium is usually transferred to and stored in a storage such as a hard disk. Further, the program may be provided as independent application software. Alternatively, as one function of an apparatus, the program may be incorporated in software of the apparatus.

Although embodiments of the present invention have been described and illustrated in detail, the disclosed embodiments are made for purposes of illustration and example only and not limitation. The scope of the present invention should be interpreted by terms of the appended claims.

What is claimed is:

1. A sheet feeding apparatus comprising:

a placer that allows a plurality of sheets to be placed on the placer;

an air feeder including a front-end fan that generates an airflow from a front-edge side in a sheet feeding direction of a bundle of sheets placed on the placer toward the bundle of sheets;

an attracting conveyor that attracts an uppermost sheet separated by the air feeder from the bundle of sheets placed on the placer and conveys the uppermost sheet;

a detector that detects, in the conveyance of the uppermost sheet by the attracting conveyor, an amount of co-feeding of a next sheet together with the uppermost sheet, the amount of co-feeding of the next sheet together with the uppermost sheet being an amount of protrusion by which the next sheet is conveyed together with the uppermost sheet, the amount of protrusion being an amount of shift of a front edge of the next sheet with respect to a position at an end of a first stage of a sheet feeding operation, wherein the first stage of the sheet feeding operation includes floating a sheet from the bundle of sheets placed on the placer and causing the attracting conveyor to attract the sheet; and a hardware processor that executes air-volume control to the front-end fan such that an air volume of the front-end fan increases with an increase in the amount of co-feeding detected by the detector.

2. The sheet feeding apparatus according to claim 1, wherein the air feeder further includes a side fan that generates an airflow from a side face side orthogonal to the sheet feeding direction of the bundle of sheets placed on the placer toward the bundle of sheets, and the hardware processor executes air-volume control to the front-end fan and the side fan such that the air volume of the front-end fan increases and an air volume of the side fan decreases with an increase in the amount of co-feeding detected by the detector.

3. The sheet feeding apparatus according to claim 2, wherein a lower limit is set in advance to the air volume of the side fan, and the hardware processor controls the air volume of the side fan not to fall below the lower limit.

4. The sheet feeding apparatus according to claim 1, wherein the hardware processor controls the sheet feeding operation that includes the first stage and a second stage, the first stage including floating the sheet from the bundle of sheets placed on the placer and causing the attracting conveyor to attract the sheet, the second stage including conveying downstream the sheet attracted to the attracting conveyor after the first stage, and the hardware processor controls the front-end fan, as the air-volume control to the front-end fan, such that the air volume of the front-end fan increases at the second stage with an increase in the amount of co-feeding detected by the detector.

5. The sheet feeding apparatus according to claim 4, further comprising:

a switch that switches a direction of the airflow from the front-end fan between a downward direction to the uppermost sheet of the bundle of sheets placed on the placer and an upward direction to the attracting conveyor disposed above the bundle of sheets placed on the placer, wherein the hardware processor causes, at the first stage, the switch to set the direction of the airflow as the downward direction, and causes, at the second stage, the switch to set the direction of the airflow as the upward direction, and controls the front-end fan such that the air volume of the front-end fan increases with an increase in the amount of co-feeding detected by the detector.

6. The sheet feeding apparatus according to claim 1, wherein, in one-by-one continuous feeding of the bundle of sheets placed on the placer, the hardware processor executes the air-volume control corresponding to the amount of co-feeding of the front-end fan, until the amount of co-feeding decreases to a predetermined amount or less after the front-end fan is activated.

7. The sheet feeding apparatus according to claim 1, wherein, in one-by-one continuous feeding of the bundle of sheets placed on the placer, the hardware processor executes the air-volume control corresponding to the amount of co-feeding until a predetermined number of sheets are fed or a predetermined time elapses after the front-end fan is activated.

8. The sheet feeding apparatus according to claim 1, further comprising:

an acquirer that acquires sheet information on the bundle of sheets placed on the placer, wherein the hardware processor executes the air-volume control with a correction table or a relational expression stored in advance in a storage, the correction table indicating a relationship between the sheet information, the amount of co-feeding, and a fan air volume or an amount of correction.

9. The sheet feeding apparatus according to claim 1, wherein the detector detects, as the amount of co-feeding, a distance by which a preceding sheet is conveyed downstream in the sheet feeding direction in conveyance of the preceding sheet by the attracting conveyor.

10. The sheet feeding apparatus according to claim 9, wherein the detector includes a sheet detection sensor that detects presence or absence of a sheet at a predetermined position on a conveyance path downstream of the attracting conveyor, and the hardware processor, in feeding the sheet, calculates the amount of co-feeding, based on an amount of conveyance or arrival time until the sheet arrives at the predetermined position after the attracting conveyor starts driving.

11. An image forming system comprising:

the sheet feeding apparatus according to claim 1; and an image former that forms an image onto a sheet fed from the sheet feeding apparatus.

12. A non-transitory recording medium storing a computer readable control program for causing a computer to control a sheet feeding apparatus to perform sheet feeding processing, the sheet feeding apparatus comprising: a placer that allows a plurality of sheets to be placed on the placer; an air feeder including a front-end fan that generates an airflow from a front-edge side in a sheet feeding direction of a bundle of sheets placed on the placer toward the bundle of sheets; an attracting conveyor that attracts an uppermost sheet separated by the air feeder from the bundle of sheets placed on the placer and conveys the uppermost sheet; and a detector that detects, in the conveyance of the uppermost sheet by the attracting conveyor, an amount of co-feeding of a next sheet together with the uppermost sheet, the amount of co-feeding of the next sheet together with the uppermost sheet being an amount of protrusion by which the next sheet is conveyed together with the uppermost sheet, the amount of protrusion being an amount of shift of a front edge of the next sheet with respect to a position at an end of a first stage of a sheet feeding operation, wherein the first stage of the sheet feeding operation includes floating a sheet from the bundle of sheets placed on the placer and causing the attracting conveyor to attract the sheet, the sheet feeding processing comprising:

detecting the amount of co-feeding by the detector; and controlling an air volume of the front-end fan in accordance with the amount of co-feeding detected by the detecting, wherein the controlling includes controlling the air volume of the front-end fan such that the air volume of the front-end fan increases with an increase in the amount of co-feeding detected by the detecting.

13. The non-transitory recording medium storing a computer readable control program according to claim 12, wherein the air feeder further includes a side fan that generates an airflow from a side face side orthogonal to the sheet feeding direction of the bundle of sheets placed on the placer toward the bundle of sheets, and the controlling includes controlling an air volume of the side fan in accordance with the amount of co-feeding detected, and controlling the air volume of the front-end fan and the air volume of the side fan such that the air volume of the front-end fan increases and the air volume of the side fan decreases with an increase in the amount of co-feeding detected by the detector.

* * * * *